US006582064B2

(12) United States Patent
Cruz-Uribe et al.

(10) Patent No.: US 6,582,064 B2
(45) Date of Patent: Jun. 24, 2003

(54) FLUID EJECTION DEVICE HAVING AN INTEGRATED FILTER AND METHOD OF MANUFACTURE

(75) Inventors: Antonio S. Cruz-Uribe, Corvallis, OR (US); Naoto A. Kawamura, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/115,294

(22) Filed: Apr. 3, 2002

(65) Prior Publication Data

US 2002/0149650 A1 Oct. 17, 2002

Related U.S. Application Data

(63) Continuation of application No. 09/597,018, filed on Jun. 20, 2000.

(51) Int. Cl.[7] ..... B41J 2/05; B41J 2/175

(52) U.S. Cl. ..... 347/63; 347/67; 347/93

(58) Field of Search ..... 347/20, 56, 63, 347/65, 67, 93

(56) References Cited

U.S. PATENT DOCUMENTS

| | | | | |
|---|---|---|---|---|
| 4,683,481 A | | 7/1987 | Johnson | 347/65 |
| 4,931,811 A | | 6/1990 | Cowger et al. | 347/92 |
| 5,409,134 A | | 4/1995 | Cowger et al. | 347/87 |
| 5,463,413 A | * | 10/1995 | Ho et al. | 347/65 |
| 5,489,930 A | | 2/1996 | Anderson | 347/93 |
| 5,659,345 A | | 8/1997 | Altendorf | 347/92 |
| 6,260,957 B1 | * | 7/2001 | Corley, Jr. et al. | 347/63 |
| 6,264,309 B1 | * | 7/2001 | Sullivan | 347/63 |

* cited by examiner

*Primary Examiner*—Thinh Nguyen
*Assistant Examiner*—Juanita Stephens

(57) ABSTRACT

A fluid ejection device includes a substrate, a stack of thin film layers and a further substrate. The substrate has a first surface and a second surface, and defines a fluid supply conduit. The stack of thin film layers has a first surface and a second surface, with the first surface of the stack of thin film layers being affixed to the second surface of the substrate. In one embodiment, the stack of thin film layers includes at least one ink energizing element, and defines a plurality of fluid filter openings that are in fluid communication with the fluid supply conduit of the substrate. The fluid filter openings function as a fluid. The further substrate has a first surface coupled to the second surface of the stack of thin film layers, and an exterior second surface. The further substrate defines at least one firing chamber positioned over the at least one fluid energizing element of the stack of thin film layers, with the firing chamber opening through a nozzle aperture in the exterior surface of the further substrate.

45 Claims, 9 Drawing Sheets

FLUID EJECTION DEVICE HAVING AN INTEGRATED FILTER AND METHOD OF MANUFACTURE

CROSS REFERENCE TO RELATED APPLICATION(S)

This is a continuation of copending application number Ser. No. 09/597,018 filed on Jun. 20, 2000, which is hereby incorporated by reference herein.

TECHNICAL FIELD

In particular, the present invention is a fluid ejection device having an integral filter, and a method of forming such a fluid ejection device.

BACKGROUND OF THE INVENTION

Throughout the business world, thermal ink jet printing systems are extensively used for image reproduction. Ink jet printing systems use cartridges that shoot droplets of colorant onto a printable surface to generate an image. Such systems may be used in a wide variety of applications, including computer printers, plotters, copiers and facsimile machines. For convenience, the concepts of the invention are discussed in the context of thermal ink jet printers. Thermal ink jet printers typically employ one or more cartridges that are mounted on a carriage that traverses back and forth across the width of a piece of paper or other medium feeding through the ink jet printer.

Each ink jet cartridge includes an ink reservoir, such as a capillary storage member containing ink, that supplies ink to the printhead of the cartridge through a standpipe. The printhead includes an array of firing chambers having orifices (also called nozzles) which face the paper. The ink is applied to individually addressable ink energizing elements (such as firing resistors) within the firing chambers. Energy heats the ink within the firing chambers causing the ink to bubble. This in turn causes the ink to be expelled out of the orifice of the firing chamber toward the paper. As the ink is expelled, the bubble collapses and more ink is drawn into the firing chambers from the capillary storage member, allowing for repetition of the ink expulsion process.

To obtain print quality and speed, it is necessary to maximize the density of the firing chambers and/or increase the number of nozzles. Maximizing the density of the firing chambers and/or increasing the number of nozzles typically necessitates an increase in the size of the printhead and/or a miniaturization of printhead components. When the density is sufficiently high, conventional manufacturing by assembling separately produced components becomes prohibitive. The substrate that supports firing resistors, the barrier that isolates individual resistors, and the orifice plate that provides a nozzle above each resistor are all subject to small dimensional variations that can accumulate to limit miniaturization. In addition, the assembly of such components for conventional printheads requires precision that limits manufacturing efficiency.

Printheads have been developed using in part manufacturing processes that employ photolithographic techniques similar to those used in semiconductor manufacturing. The components are constructed on a flat wafer by selectively adding and subtracting layers of various materials using these photolithographic techniques. Some existing printheads are manufactured by printing a mandrel layer of sacrificial material where firing chambers and ink conduits are desired, covering the mandrel with a shell material, then etching or dissolving the mandrel to provide a chamber defined by the shell.

In print cartridges typically used in thermal ink jet printers, a filter element is generally placed at the inlet of the standpipe against the ink reservoir (i.e., capillary storage member). The filter element acts as a conduit for ink to the inlet of the standpipe and prevents drying of ink in the capillary storage member adjacent the inlet of the standpipe. In addition, the filter element precludes debris and air bubbles from passing from the ink reservoir into the standpipe and therefrom into the printhead. Without a filter element, debris and/or air bubbles could enter the printhead and cause clogging of the ink flow channels, conduits, chambers and orifices within the printhead. This clogging is likely to result in one or more inoperable firing chambers within the printhead, which would require that the ink jet print cartridge, with the clogged printhead, be replaced with a new ink jet cartridge before the ink in the clogged cartridge is exhausted. From the perspective of cost, this course of action is undesirable.

The filter element within the ink jet print cartridge also helps to prevent pressure surges and spike surges of ink from the ink reservoir to the standpipe. A pressure surge of ink occurs upon oscillation of the print cartridge during movement of the carriage of the printer. A pressure surge can cause ink to puddle within the orifices of the firing chambers. This puddled ink can dry up clogging the firing chambers. A spike surge of ink occurs when the ink jet cartridge is jarred or dropped. In a spike surge, ink is rapidly displaced within the ink jet cartridge, which could allow air to be gulped into the firing chambers of the printhead, causing these chambers to de-prime. In these instances, the filter element, because it restricts ink fluid flow, helps to prevent unwanted puddling of ink within the nozzles and/or depriming of the firing chambers. However, since the filter element is rigid and positioned at the inlet of the standpipe, the filter element is somewhat ineffective for preventing pressure surges and spike surges for the ink within the standpipe itself

SUMMARY OF THE INVENTION

One aspect of the present invention provides a fluid ejection device. The fluid ejection device comprises a substrate, a stack of thin film layers and a further substrate. The substrate has a first surface and a second surface, and defines a fluid supply conduit. The stack of thin film layers has a first surface and a second surface, with the first surface of the stack of thin film layers being affixed to the second surface of the substrate. In one embodiment, the stack of thin film layers includes at least one fluid energizing element, and defines a plurality of fluid filter openings in fluid communication with the fluid supply conduit of the substrate. The fluid filter openings function as a fluid filter. The further substrate has a first surface coupled to the second surface of the stack of thin film layers, and an exterior second surface. The further substrate defines at least one firing chamber positioned over the at least one fluid energizing element of the stack of thin film layers, with the firing chamber opening through a nozzle aperture in the exterior second surface of the further substrate.

BRIEF DESCRIPTION OF THE DRAWINGS

The accompanying drawings are incorporated in and constitute a part of this specification. The drawings illustrate the embodiments of the present invention. In the accompanying drawings like reference numerals designate like parts throughout.

DETAILED DESCRIPTION

Figure 1:
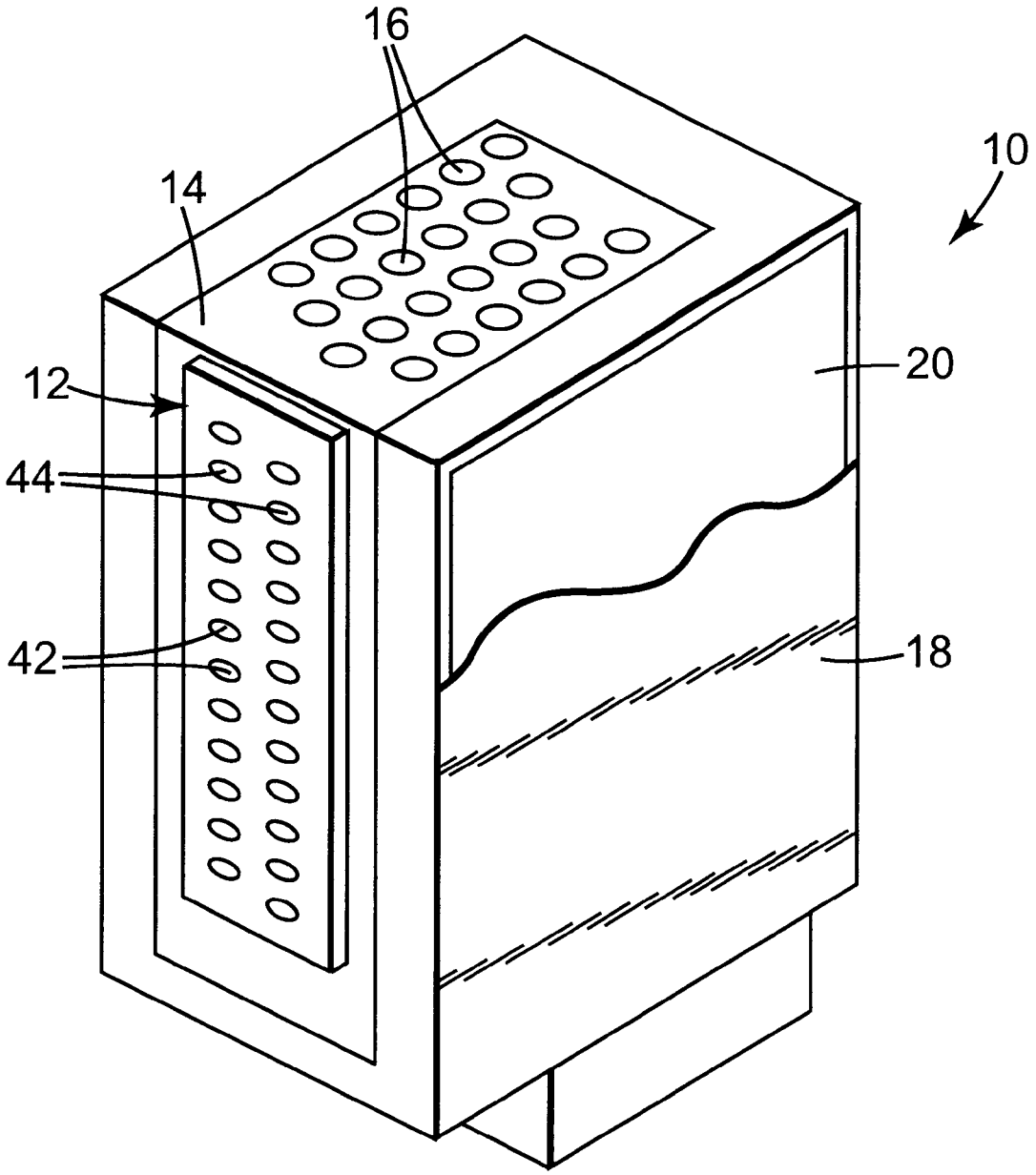
FIG. 1 is a perspective view of a cartridge incorporating a printhead with an integrated filter in accordance with an embodiment of the present invention.

A thermal ink jet print cartridge 10 having an ink jet printhead 12 in accordance with the present invention is illustrated generally in FIG. 1. In the ink jet cartridge 10, the printhead 12 is bonded onto a flex circuit 14 that couples control signals from electrical contacts 16 to the printhead 12. The printhead 12 and the flex circuit 14 are mounted to a cartridge housing 18 of the ink jet cartridge 10. Fluid ink is held within the housing 18 of the ink jet cartridge 10 in an ink fluid reservoir, such as a capillary storage member 20. The capillary storage member 20 is in fluid communication with the printhead 12 via a suitable fluid delivery assemblage which may include a standpipe (not shown).

Figure 2:
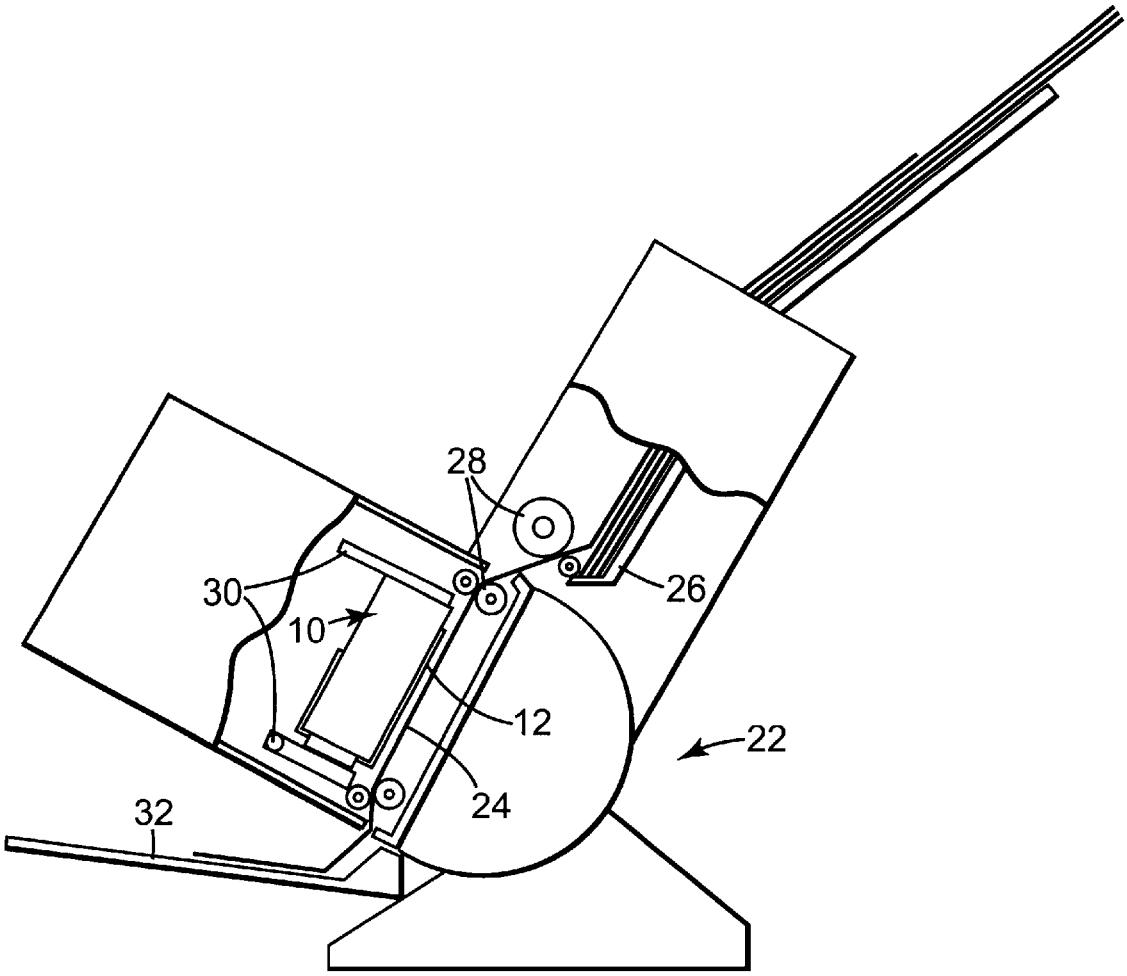
FIG. 2 is a side elevational view, partially in section, of a printer using the cartridge shown in FIG. 1.

As seen in FIG. 2, the ink jet cartridge 10 having the ink jet printhead 12 in accordance with the present invention, can be used in a thermal ink jet printer 22. Medium 24 (such as paper) is taken from a medium tray 26 and conveyed along its length across the ink jet cartridge 10 by a medium feed mechanism 28. The ink jet cartridge 10 is conveyed along the width of the medium 24 on a carriage assemblage 30. The medium feed mechanism 28 and carriage assemblage 30 together form a conveyance assemblage for transporting the medium 24. When the medium 24 has been recorded onto, it is ejected onto a medium output tray 32.

Figure 3:
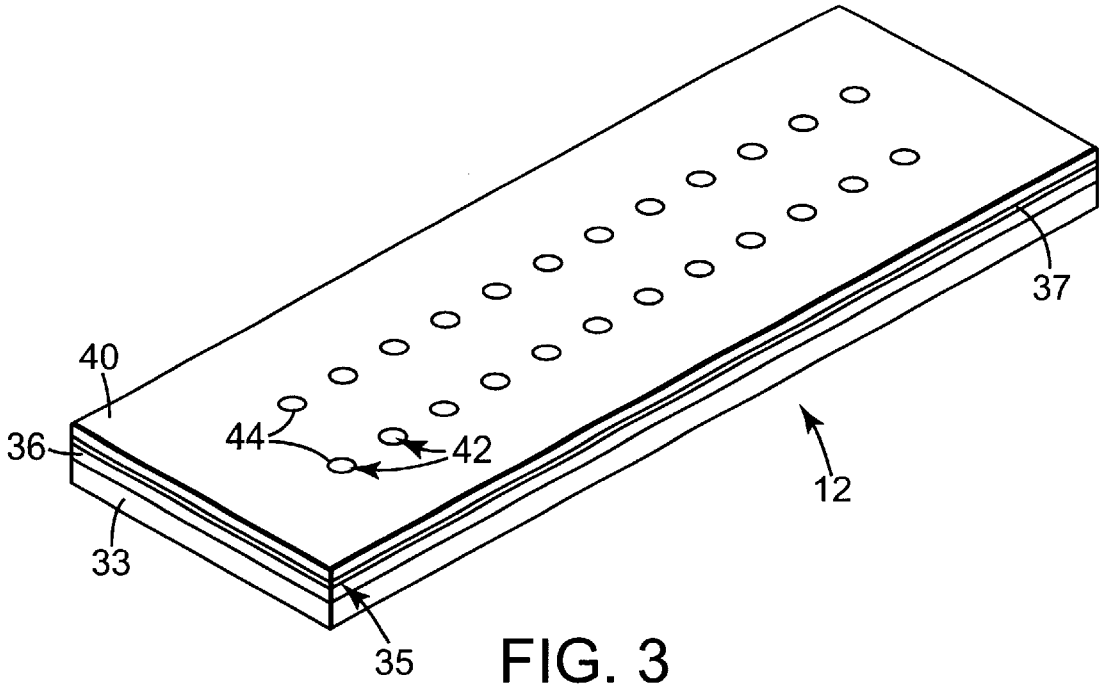
FIG. 3 is a perspective view of the printhead with integrated filter shown in FIG. 1.
Figure 4:
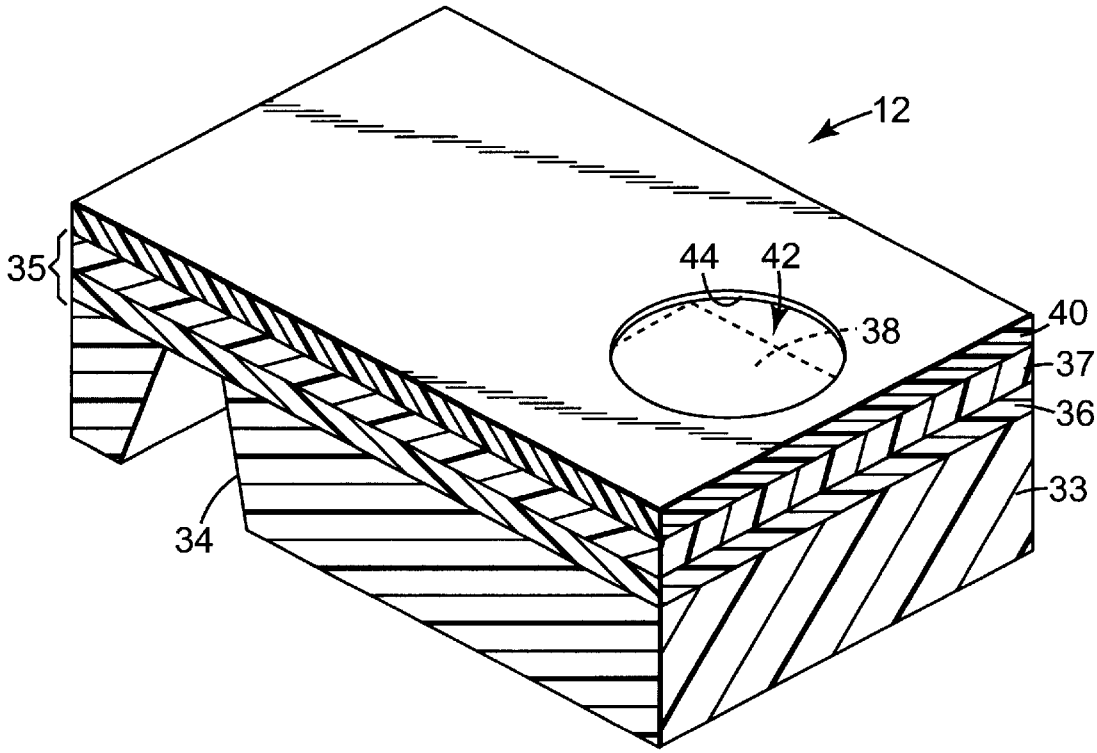
FIG. 4 is an enlarged sectional perspective view of a single firing chamber of the printhead with integrated filter shown in FIG. 3.

As seen best in FIGS. 3 and 4, the ink jet printhead 12, of the present invention, includes a first substrate, such as a semiconductor silicon substrate 33 that provides a rigid chassis for the printhead 12, and which accounts for the majority of the thickness of the printhead 12. The silicon substrate 33 defines an ink fluid supply conduit 34 that is in fluid communication with the capillary storage member 20 (i.e., ink fluid reservoir) of the ink jet cartridge 10. A second substrate 35 is affixed to the silicon substrate 33. The second substrate 35 includes a stack of thin film layers 36 and a barrier layer 37. The stack of thin film layers 36 is affixed to the silicon substrate 33, and the barrier layer 37 is affixed to the stack of thin film layers 36. The stack of thin film layers 36 includes a plurality of independently addressable ink energizing elements, such as resistors 38 (see FIG. 4). The resistors are electrically connected to an activation source (not shown for clarity) for providing electrical energy to the resistors 38 to heat them. An orifice layer 40 is affixed to the barrier layer 37. The orifice layer 40 is the uppermost layer of the ink jet printhead 12, and faces the medium 24 on which ink is to be printed. The orifice layer 40, barrier layer 37 and thin film layers defines a plurality of firing chambers 42. The firing chambers 42 are positioned over the resistors 38 of the stack of thin film layers 36, such that each firing chamber 42 is in registration with a respective resistor 38. Each of the firing chambers 42 opens through an orifice, such as a nozzle aperture 44 through which ink may be selectively expelled from the orifice layer 40 of the ink jet printhead 12.

FIGS. 5A–5G illustrate a sequence of steps for manufacturing a first preferred ink jet printhead embodiment 12 in accordance with the present invention. The silicon substrate 33 is provided in FIG. 5A. The silicon substrate 33 has a first or lower surface 46 and a second or upper surface 48. The silicon substrate 33 is a semiconductor silicon wafer about 625 $\mu$m thick, although glass or a stable polymer may be substituted. The stack of thin film layers 36 is affixed to the entire silicon substrate 33 in FIG. 5B. The stack of thin film layers 36 has a first or lower surface 50 and a second or upper surface 52. The stack of thin film layers 36 is formed in a known manner prior to be applied to the silicon substrate 33. The stack of thin film layers 36 is about 2 $\mu$m thick. The stack of thin film layers 36 include the plurality of resistors 38 and conductive traces (not shown). The stack of thin film layers 36 is laid down layer upon layer on the upper surface 48 of the silicon substrate 33.

Figure 5A:
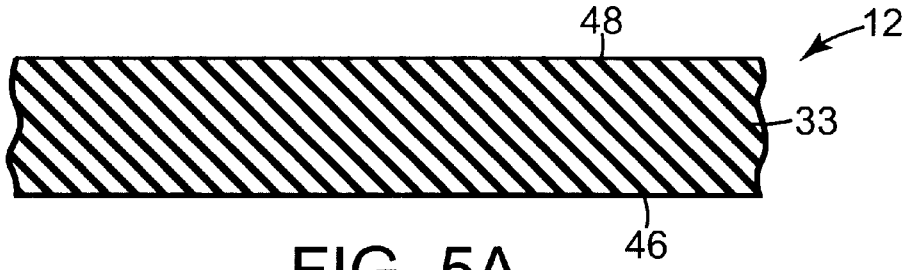
FIGS. 5A–5G are cross sectional views illustrating a sequence of manufacturing steps to form the printhead with integrated filter in accordance with an embodiment of the present invention.
Figure 5B:
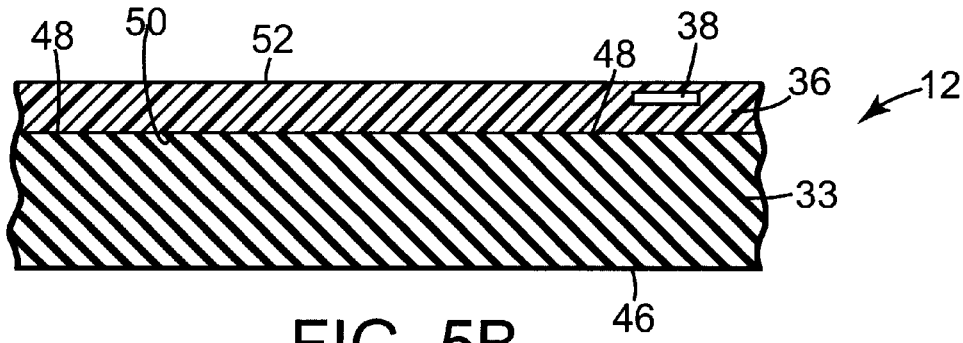
Figure 5C:
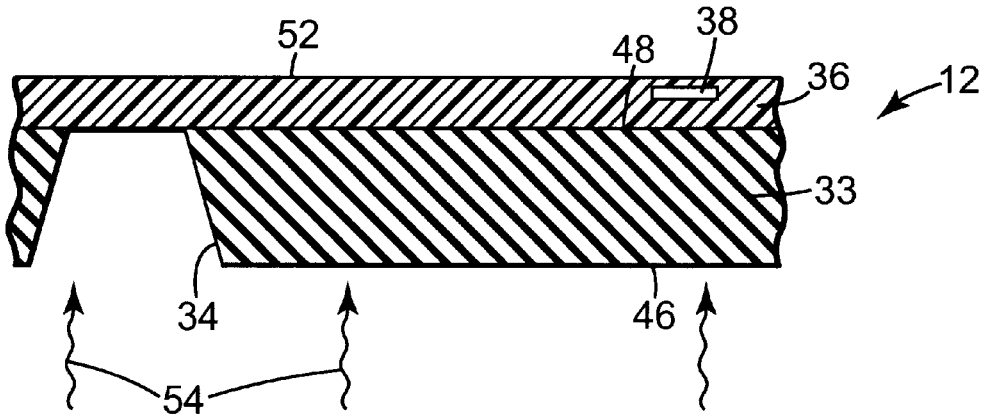

In FIG. 5C, the ink fluid supply conduit 34 is formed by selectively removing material from the silicon substrate 33 from the direction of the lower surface 46 of the silicon substrate. In particular, the ink fluid supply conduit 34 is etched in a known manner by anisotropic etching 54 (also known as wet chemical etching) to form the angled profile of the ink fluid supply conduit 34 shown in FIGS. 4 and 5C. The etching process ceases when the lower surface 50 of the stack of thin film layers 36 is reached. The position of the ink fluid supply conduit 34 in the silicon substrate 33 is dictated in a known manner through the use of a mask that determines where the etching process removes material from the silicon substrate 33. The ink fluid supply conduit 34 is a tapered trench that is widest at the lower surface 46 of the silicon substrate 33 to receive ink from the capillary storage member 20. The tapered trench narrows toward the stack of thin film layers 36. The tapered walls of the ink fluid supply conduit 34 have a wall angle of 54° from the plane of the silicon substrate 33. In essence the ink fluid supply conduit 34 is an ink fluid manifold that extends laterally along the silicon substrate 33 that is in fluid communication with more than one resistor 38.

Figure 5D:
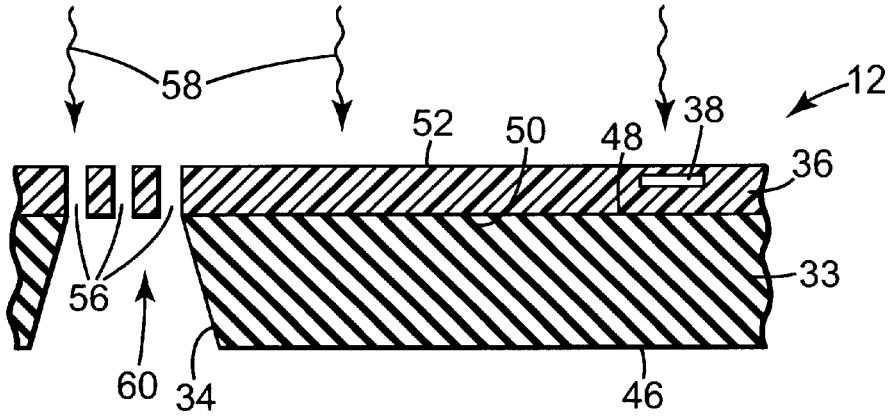

In FIG. 5D, a plurality of fluid filter openings 56 are formed by selectively removing material from the stack of thin film layers 36 from the direction of the upper surface 52 of the stack of thin film layers 36. In particular, the plurality of fluid filter openings 56 are etched in a known manner by isotropic etching 58 (also known as a dry plasma etch) to form fluid filter openings 56 in fluid communication with the ink fluid supply conduit 34 of the silicon substrate 33. In practice, the stack of thin film layers 36 is covered with a light sensitive photoresist polymer. A mask is then placed on top of this light sensitive photoresist polymer on the upper surface 52 of the stack of thin film layers 36. The mask determines where the eventual isotropic etching 58 process will remove material from the stack of thin film layers 36. The stack of thin film layers 36 is then exposed to ultraviolet (UV) light through the mask, which hardens (i.e., cures) those areas of the light sensitive photoresist polymer exposed to the UV light. The mask is then removed and an etching process etches away those areas of the light sensitive photoresist polymer that were not exposed to the UV light to define the plurality of fluid filter openings 56. The previously referenced isotropic etching 58 (i.e., dry plasma etch)

is then used to remove those areas of the thin film stack 36 to form the fluid filter openings 56 in the thin film stack 36. Alternatively, the fluid filter openings can be formed using the known process of laser ablation.

The fluid filter openings 56 function as an ink fluid filter 60 for the printhead 12. The fluid filter openings 56 filter the ink from the sponge 20 and preclude debris and air bubbles from reaching the firing chambers 42 of the printhead 12. The number of the fluid filter openings 56, the diameter of each of the fluid filter openings 56 and the thickness of the stack of thin film layers all determine the filter capabilities and capacity of the ink fluid filter 60. Preferably there are a plurality of fluid filter openings associated with each firing chamber 42 and each fluid filter opening 56 serves more than one firing chamber 42.

Figure 5E:
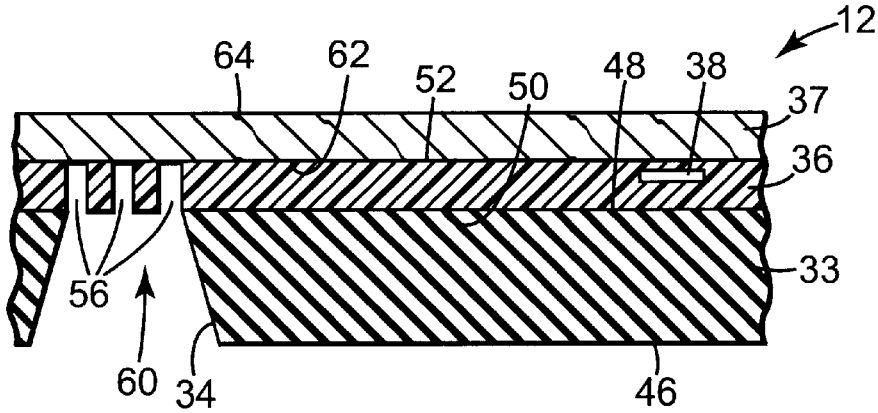

In FIG. 5E, the barrier layer 37 is affixed to the entire stack of thin film layers 36. The barrier layer 37 has a first or lower surface 62 and a second or upper surface 64. The barrier layers 37 is 3–30 $\mu$m thick and is a light sensitive photoresist polymer having a different etchant sensitivity than the stack of thin film layers 36. The lower surface 62 of the barrier layer 37 is affixed to the upper surface 52 of the stack of thin film layers 36, in a known manner, by placing the barrier layer 37 on the stack of thin film layers 36, then heating and applying pressure to the barrier layer 37 which causes the barrier layer 37 to adhere to the stack of thin film layers 36.

Figure 5F:
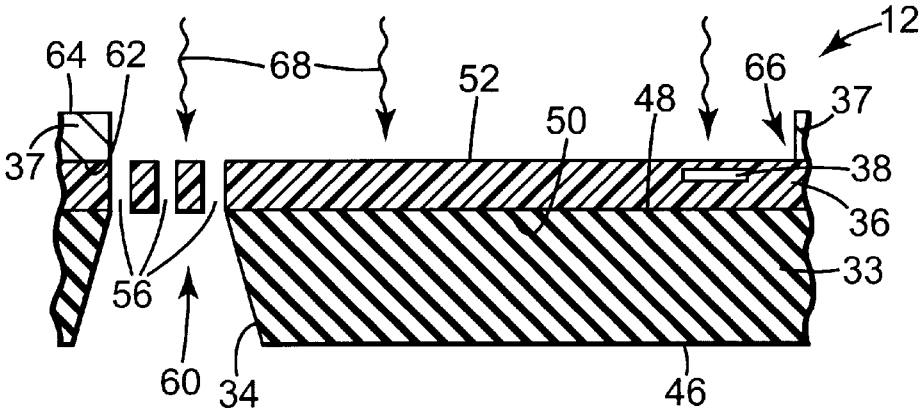

In FIG. 5F, a ink fluid channel 66 is formed by selectively removing material from the barrier layer 37 from the direction of the upper surface 64 of the barrier layers 37. In particular, the fluid channel 66 runs laterally along the barrier layer 37, and is etched in a known manner by isotropic etching 68 (also known as a dry plasma etch) to form the fluid channel 66 which is in fluid communication with the fluid filter openings 56 and the resistors 38. In practice, since the barrier layer 37 is a light sensitive photoresist polymer, a mask is first placed on top of the upper surface 64 of the barrier layer 37. The mask determines where the etching process will remove material from the barrier layer 37. The barrier layer 37 is then exposed to ultra-violet (UV) light through the mask, which hardens (i.e., cures) those areas of the barrier layer 37 exposed to the UV light. The mask is then removed and the etching process etches away those areas of the barrier layer 37 that were not exposed to the UV light to form the fluid channel 66.

Figure 5G:
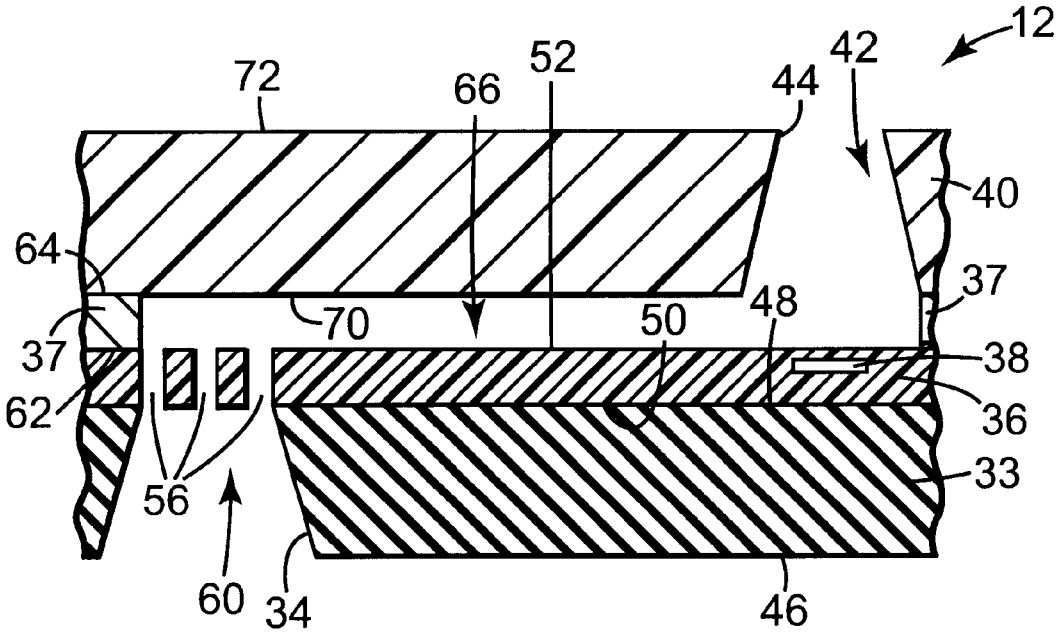

In FIG. 5G, the orifice layer 40 is affixed to the entire barrier layer 37. The orifice layer 40 has a first or lower surface 70 and a second or upper surface 72. The orifice layer 40 is about 30 $\mu$m thick and is either made of a light sensitive photoresist polymer or nickel (Ni). The lower surface 70 of the orifice layer 40 is affixed to the upper surface 64 of the barrier layer 37, in a known manner, by placing the orifice layer 40 on the barrier layer 37, then heating and applying pressure to the orifice layer 40 which causes the barrier layer 37 to adhere to the orifice layer 40. The firing chambers 42 are in registration with the resistors 38 of the stack of thin film layers 36. Each firing chamber 42 is generally frustoconical in shape with the wider portion positioned adjacent the respective resistor 38 and the narrower nozzle aperture 44 opening through the upper (i.e., exterior) surface 72 of the orifice layer 40.

The firing chambers 42 and nozzle apertures 44 are formed in a known manner in the orifice layer 40 prior to the orifice layer 40 being affixed to the barrier layer 37. In the case of a nickel orifice layer 40, the firing chambers 42 and nozzle apertures 44 are formed during the formation of the orifice layer itself using known electroforming processes. In the case of a light sensitive photoresist polymer orifice layer 40, the firing chambers 42 and nozzle apertures 44 are formed by selectively removing material from the orifice layer 40 from the direction of the lower surface 70 of the orifice layer 40. In particular, the firing chambers 42 and nozzle apertures 44 are etched in a known manner by isotropic etching (also known as a wet chemical etch). The manufacturing process for the first preferred embodiment of the ink jet printhead 12 having an integrated filter 60 is now complete and the printhead 12 is ready for mounting to the housing 18 of the ink jet cartridge 10.

Figure 6A:
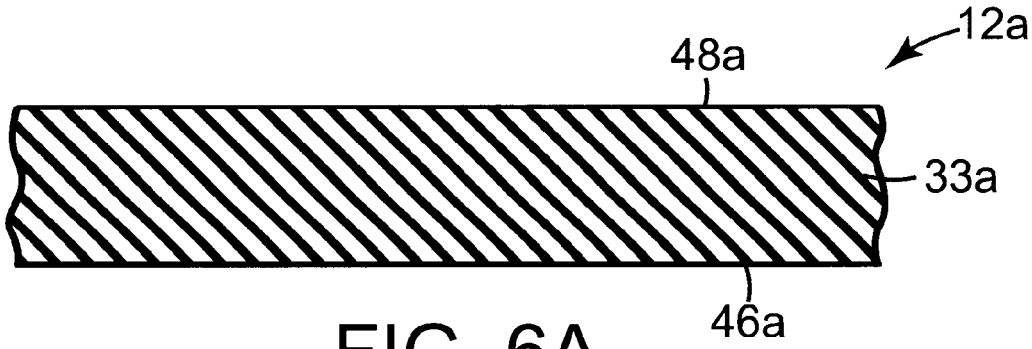
FIGS. 6A–6F are cross sectional views illustrating a sequence of manufacturing steps to form the printhead with integrated filter in accordance with an alternative embodiment of the present invention.
Figure 6B:
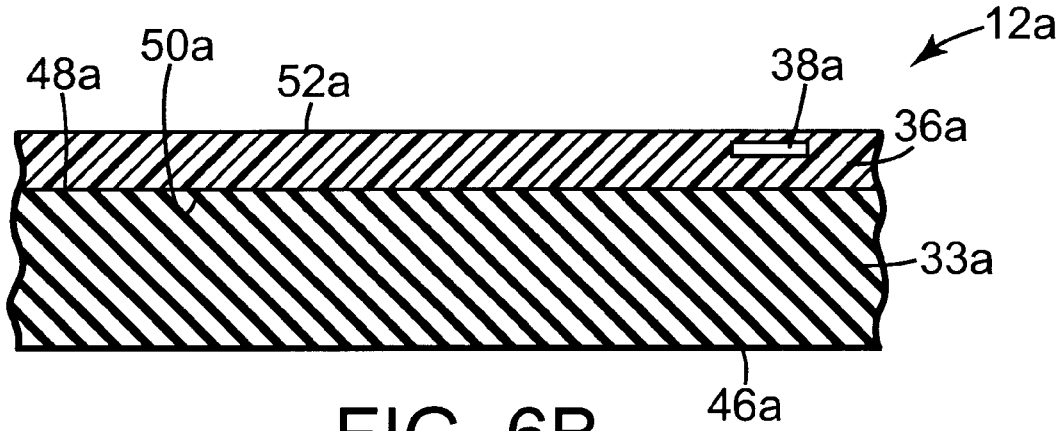

FIGS. 6A–6F illustrate a sequence of steps for manufacturing a second alternative ink jet printhead embodiment 12*a* in accordance with the present invention. Like parts are labeled with like numerals except for the addition of the subscript "a". The manufacturing steps and composition of printhead components illustrated in FIGS. 6A–6B are identical to the manufacturing steps and composition of printhead components illustrated in FIGS. 5A–5B and therefore will not be described with particularity.

Figure 6C:
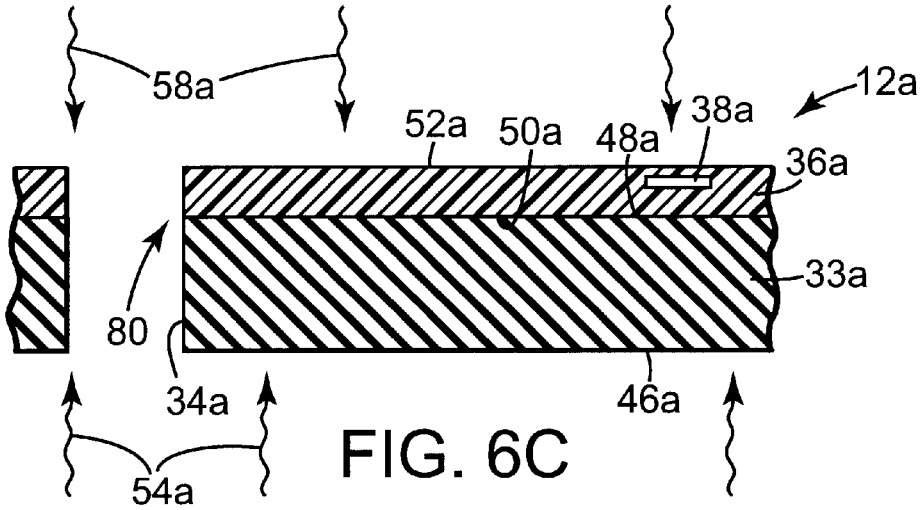

In FIG. 6C, the ink fluid conduit 34*a* and a fluid feed passageway 80 are formed by selectively removing material from the silicon substrate 33 and the stack of thin film layers 36*a*, respectively, from the direction of the lower surface 46*a* of the silicon substrate 33*a*. In particular, the ink fluid conduit 34*a* and the fluid feed passageway 80 are formed via sand blasting in a known manner. The silicon substrate 33*a* and the stack of thin film layers 36*a* are sand blasted using a sand blasting cutting tool that forms the ink fluid conduit 34*a* and a fluid feed passageway 80. In this instance, the walls of the ink fluid conduit 34*a* are straight as opposed to the angled side walls of the ink fluid conduit 34 in FIG. 5C. Alternatively, the ink fluid conduit 34*a* and the fluid feed passageway 80 can be formed using the known process of laser ablation.

Figure 6D:
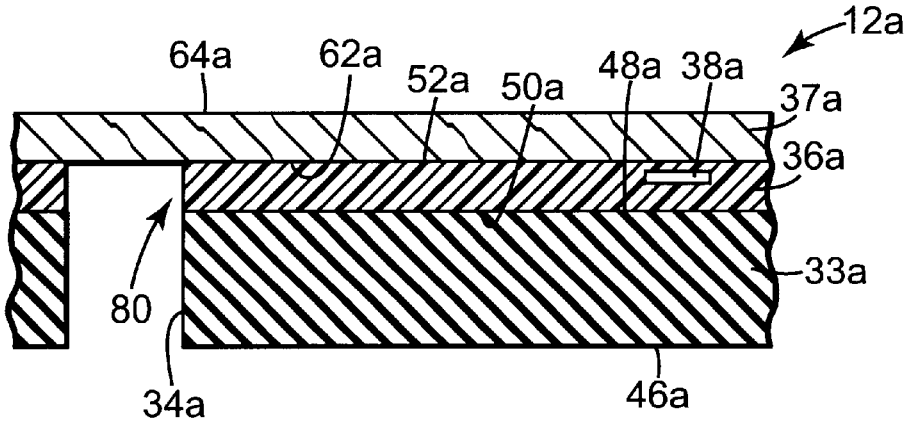

In FIG. 6D, the barrier layer 37*a* is affixed to the entire stack of thin film layers 36*a*. The barrier layer 37*a* has a first or lower surface 62*a* and a second or upper surface 64*a*. The barrier layer 37*a* is 3–30 $\mu$m thick and is a light sensitive photoresist polymer having a different etchant sensitivity than the stack of thin film layers 36*a*. The lower surface 62*a* of the barrier layer 37*a* is affixed to the upper surface 52*a* of the stack of thin film layers 36*a*, in a known manner, by placing the barrier layer 37*a* on the stack of thin film layers 36*a*, then heating and applying pressure to the barrier layer 37*a* which causes the barrier layer 37*a* to adhere to the stack of thin film layers 36*a*.

Figure 6E:
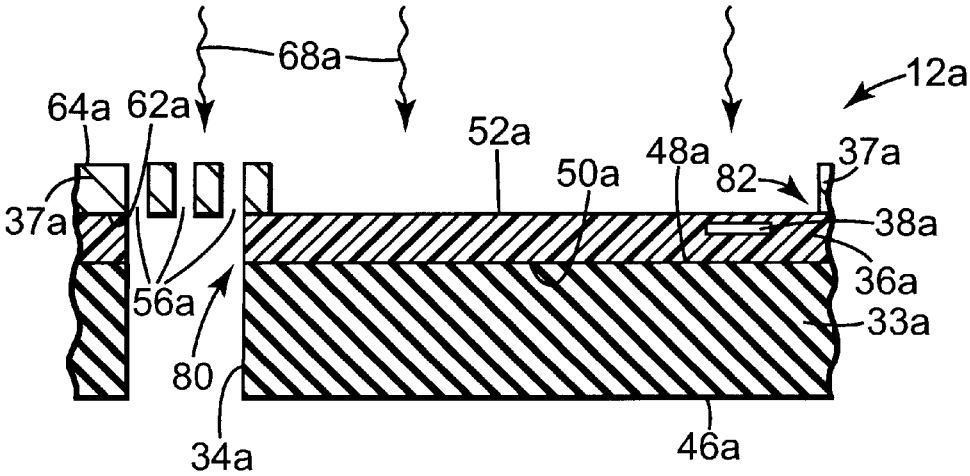

In FIG. 6E, a plurality of fluid filter openings 56*a* and a barrier layer fluid channel 82 are formed by selectively removing material from the barrier layer 37*a* from the direction of the upper surface 64*a* of the barrier layer 37*a*. In particular, the plurality of fluid filter openings 56*a* and the barrier layer fluid channel 82 are etched in a known manner by isotropic etching 68*a*. The fluid filter openings 56*a* are in fluid communication with the fluid feed passageway 80 of the stack of thin film layers 36*a*. The barrier layer fluid channel 82 is in fluid communication with the resistors 38*a*. In practice, since the barrier layer 37*a* is a light sensitive photoresist polymer, a mask is first placed on top of the upper surface 64*a* of the barrier layer 37*a*. The mask determines where the etching process will remove material from the barrier layers 37*a*. The barrier layer 37*a* is then exposed to ultraviolet (UV) light through the mask, which hardens (i.e., cures) those areas of the barrier layer 37*a* exposed to the UV light. The mask is then removed and the etching process etches away those areas of the barrier layer 37*a* that were not exposed to the UV light to form the plurality of fluid filter openings 56*a* and the barrier layer fluid channel 82.

The fluid filter openings 56*a* function as a compliant ink fluid filter 60*a* for the printhead 12*a*. The fluid filter openings 56*a* filter the ink from the capillary storage member 20 and preclude debris and air bubbles from reaching the firing chambers 42*a* of the printhead 12*a*. The number of the fluid filter openings 56*a*, the diameter of each of the fluid filter openings 56*a* and the thickness of the barrier layer 37*a* all determine the filter capabilities and capacity of the ink fluid filter 60*a*.

Figure 6F:
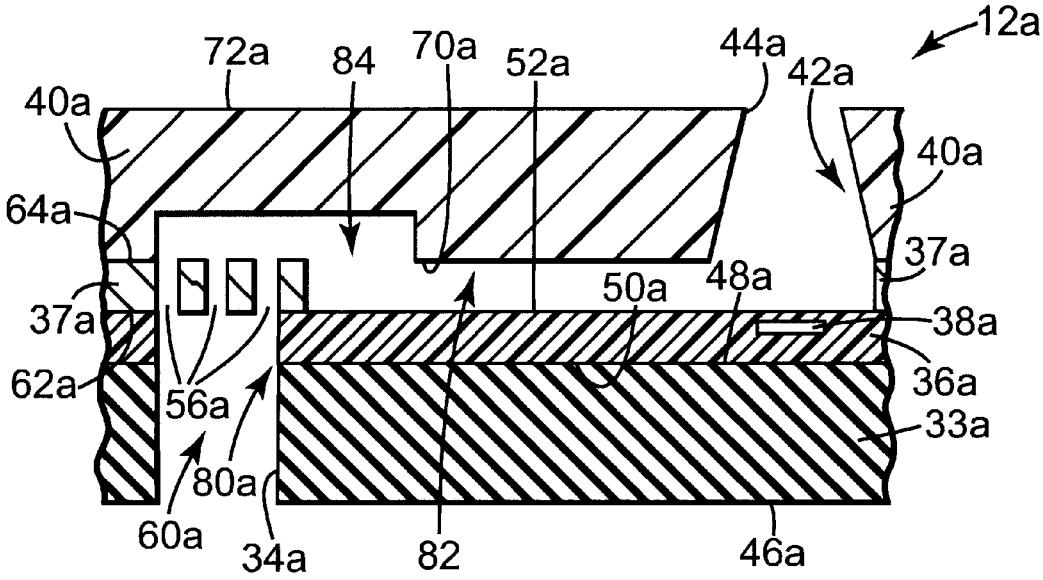

In FIG. 6F, the orifice layer 40*a* is affixed to the entire barrier layer 37*a*. The orifice layer 40 has a first or lower surface 70*a* and a second or upper surface 72*a*. The orifice layer 40*a* is 10–30 $\mu$m thick and is either made of a light sensitive photoresist polymer or nickel (Ni). The lower surface 70*a* of the orifice layer 40*a* is affixed to the upper surface 64*a* of the barrier layer 37*a*, in a known manner, as previously described in relation to FIG. 5G. The firing chambers 42*a* are in registration with the resistors 38*a* of the stack of thin film layers 36*a*, and are in fluid communication with the barrier layer fluid channel 82. Each firing chamber 42*a* is generally frustoconical in shape with the wider portion positioned adjacent the respective resistor 38*a* and the narrower nozzle aperture 44*a* opening through the upper (i.e., exterior) surface 72*a* of the orifice layer 40*a*.

The firing chambers 42*a* and nozzle apertures 44*a* and an orifice layer fluid channel 84 are formed in a known manner in the orifice layer 40*a* prior to the orifice layer 40*a* being affixed to the barrier layer 37*a*. The orifice layer fluid channel 84 is in fluid communication with the barrier layer fluid channel 82 and the fluid filter openings 56*a*. In the case of a nickel orifice layer 40*a*, the firing chambers 42*a*, the nozzle apertures 44*a* and the orifice layer fluid channel 84 are formed into the orifice layer itself using known electroforming processes. In the case of a light sensitive photoresist polymer orifice layer 40*a*, the firing chambers 42*a*, the nozzle apertures 44*a* and the orifice layer fluid channel 84 are formed by selectively removing material from the orifice layer 40*a*. The manufacturing process for the second alternative embodiment of the ink jet printhead 12*a* having an integrated filter 60*a* is now complete and the printhead 12*a* is ready for mounting to the housing 18 of the inkjet cartridge 10.

In summary, by integrating the filter 60, 60*a* for the ink of a thermal ink jet cartridge 10 into the ink jet cartridge printhead 12, 12*a* itself, the filter 60, 60*a* is mounted to the inkjet cartridge 10 when the printhead 12, 12*a* is attached to the cartridge 10 instead of separately as in prior art designs. This results in the elimination of ink jet cartridge assembly steps which translates into manufacturing cost savings. In addition, since the unitary printhead 12, 12*a* and filter 60, 60*a* of the present invention is manufactured using semiconductor manufacturing processes, the resulting unitary printhead 12, 12*a* and filter 60, 60*a* is very precise and hence extremely reliable. Therefore, the printhead 12, 12*a* and integrated filter 60, 60*a* should perform dependably throughout the useful life of the ink jet cartridge 10 so as to preclude premature replacement of the ink jet cartridge 10 and the associated cost. Moreover, the filter 60, 60*a* of the unitary printhead 12, 12*a* and filter 60, 60*a* of the present invention, substantially precludes debris and air bubbles from clogging, restricting the flow of ink, and/or otherwise interfering with operation of the printhead components, such as the resistors 38, 38*a* and the firing chambers 42, 42*a*. In addition, the close proximity of the filter 60, 60*a* to the firing chambers 42, 42*a* allows the back flow of ink created upon firing of the firing chambers to dislodge bubbles and/or debris at the filter 60, 60*a*. Lastly, the filter 60, 60*a* of the unitary printhead 12, 12*a* and filter 60, 60*a* of the present invention, is extremely effective against pressure and spike surges of ink that can occur during normal operation of the ink jet cartridge or when the inkjet cartridge is jarred or dropped since the filter 60, 60*a* is somewhat compliant so as to absorb some of these surges and is integrated into the printhead 12, 12*a* and not at the head of the ink jet cartridge standpipe as in prior art designs.

Although the present invention has been described with reference to preferred embodiments, workers skilled in the art will recognize that changes may be made in form and detail without departing from the spirit and scope of the invention.

What is claimed is:

1. A fluid ejection device comprising:

a substrate having a first surface and a second surface, the substrate defining a fluid supply conduit;

a stack of thin film layers having a first surface and a second surface, the first surface of the stack of thin film layers being affixed to the second surface of the substrate, the stack of thin film layers including at least one fluid energizing element, and the stack of thin film layers defining a plurality of fluid filter openings in fluid communication with the fluid supply conduit of the substrate, each fluid filter opening of the plurality of fluid filter openings extending only through the stack of thin film layers from the first surface to the second surface thereof, the plurality of fluid filter openings functioning as a fluid filter; and a further substrate having a first surface affixed to the second surface of the stack of thin film layers, and an exterior second surface, the further substrate defining at least one firing chamber positioned over the at least one fluid energizing element of the stack of thin film layers, with the at least one firing chamber opening through at least one nozzle aperture in the exterior second surface of the further substrate.

2. The fluid ejection device of claim 1 wherein the further substrate includes:

a barrier layer having a first surface affixed to the second surface of the stack of thin film layers, and a second surface; and an orifice layer having a first surface affixed to the second surface of the barrier layer, and the exterior second surface, the orifice layer defining the at least one firing chamber and the at least one nozzle aperture in the exterior second surface.

3. The fluid ejection device of claim 2 wherein the barrier layer defines a fluid channel in fluid communication with the plurality fluid filter openings of the stack of thin film layers and the at least one firing chamber of the orifice layer.

4. The fluid ejection device of claim 1 wherein the stack of thin film layers includes a plurality of independently addressable fluid energizing elements, and wherein the further substrate includes a plurality of firing chambers and nozzle apertures, such that each fluid energizing element of the plurality of independently addressable fluid energizing elements has its own firing chamber and nozzle aperture.

5. The fluid ejection device of claim 4 wherein each fluid filter opening of the plurality of fluid filter openings of the stack of thin film layers is in fluid communication with more than one of the firing chambers of the plurality of independently addressable fluid energizing elements.

6. A fluid ejection device comprising:

a first substrate having a first surface and a second surface, the first substrate defining a fluid supply conduit;

a stack of thin film layers having a first surface and a second surface, the first surface of the stack of thin film layers being affixed to the second surface of the first substrate, the stack of thin film layers including at least one fluid energizing element; and a chamber layer having a first surface affixed to the second surface of the stack of thin film layers, and a second surface, the chamber layer defining at least one firing chamber positioned over the at least one fluid energizing element of the stack of thin film layers, wherein one of the stack of thin film layers and the chamber layer defines a plurality of fluid filter openings in fluid communication with the fluid supply conduit of the first substrate, each fluid filter opening of the plurality of fluid filter openings extending only through one of the stack of thin film layers and the chamber layer from the first surface to the second surface thereof, the plurality of fluid filter openings functioning as a fluid filter.

7. The fluid ejection device of claim 6 wherein the stack of thin film layers defines the plurality of fluid filter openings.

8. The fluid ejection device of claim 7 wherein the chamber layer defines a fluid channel in fluid communication with the plurality fluid filter openings of the stack of thin film layers and the at least one firing chamber of the chamber layer.

9. The fluid ejection device of claim 6 wherein the stack of thin film layers includes a plurality of independently addressable fluid energizing elements, and wherein the chamber layer includes a plurality of firing chambers and nozzle apertures, such that each fluid energizing element of the plurality of independently addressable fluid energizing elements has its own firing chamber and nozzle aperture.

10. The fluid ejection device of claim 9 wherein each fluid filter opening of the plurality of fluid filter openings of the stack of thin film layers is in fluid communication with more than one of the firing chambers of the plurality of independently addressable fluid energizing elements.

11. The fluid ejection device of claim 6 wherein the chamber layer defines the plurality of fluid filter openings.

12. The fluid ejection device of claim 11 wherein the stack of thin film layers define a fluid feed passageway in fluid communication with the fluid supply conduit of the first substrate.

13. The fluid ejection device of claim 12 wherein the chamber layer further defines a chamber layer fluid channel in fluid communication with the plurality of fluid filter openings of the chamber layer and the at least one firing chamber of the chamber layer.

14. The fluid ejection device of claim 13 wherein the chamber layer further defines a further chamber layer fluid channel in fluid communication with the plurality of fluid filter openings of the chamber layer and the chamber layer fluid channel.

15. The fluid ejection device of claim 6 wherein the chamber layer includes:

a barrier layer defining the first surface of the chamber layer affixed to the second surface of the stack of thin film layers, and a second surface; and an orifice layer having a first surface affixed to the second surface of the barrier layer, and an exterior second surface defined by the second surface of the chamber layer, the orifice layer defining the at least one firing chamber positioned over the at least one fluid energizing element of the stack of thin film layers, with the at least one firing chamber opening through at least one nozzle aperture in the exterior second surface of the orifice layer.

16. The fluid ejection device of claim 11 wherein the chamber layer includes:

a barrier layer defining the first surface of the chamber layer affixed to the second surface of the stack of thin film layers, and a second surface; and an orifice layer having a first surface affixed to the second surface of the barrier layer, and an exterior second surface defined by the second surface of the chamber layer, the orifice layer defining the at least one firing chamber positioned over the at least one fluid energizing element of the stack of thin film layers, with the at least one firing chamber opening through at least one nozzle aperture in the exterior second surface of the orifice layer.

17. The fluid ejection device of claim 16 wherein the barrier layer defines the plurality of fluid filter openings.

18. A fluid ejection device comprising:

a first substrate having a first surface and a second surface, the first substrate defining a fluid supply conduit;

a stack of thin film layers having a first surface and a second surface, the first surface of the stack of thin film layers being coupled with the second surface of the first substrate, the stack of thin film layers including at least one fluid energizing element, and the stack of thin film layers defining a plurality of fluid filter openings in fluid communication with the fluid supply conduit of the first substrate, each fluid filter opening of the plurality of fluid filter openings extending only through the stack of thin film layers from the first surface to the second surface thereof the plurality of fluid filter openings functioning as a fluid filter;

a chamber layer having a first surface coupled with the second surface of the stack of thin film layers, and a second surface, the chamber layer defining at least one firing chamber in fluid communication with the plurality of fluid filter openings of the stack of thin film layers, the at least one firing chamber being positioned over the at least one fluid energizing element of the stack of thin film layers.

19. The fluid ejection device of claim 18 wherein the chamber layer defines a fluid channel in fluid communication with the plurality fluid filter openings of the stack of thin film layers and the at least one firing chamber of the chamber layer.

20. The fluid ejection device of claim 19 wherein the fluid channel extends laterally along the chamber layer.

21. The fluid ejection device of claim 18 wherein the stack of thin film layers includes a plurality of independently addressable fluid energizing elements, and wherein the chamber layer includes a plurality of firing chambers and nozzle apertures, such that each fluid energizing element of the plurality of independently addressable fluid energizing elements has its own firing chamber and nozzle aperture.

22. The fluid ejection device of claim 21 wherein each fluid filter opening of the plurality of fluid filter openings of the stack of thin film layers is in fluid communication with more than one of the firing chambers of the plurality of independently addressable fluid energizing elements.

23. The fluid ejection device of claim 21 wherein the chamber layer defines a fluid channel in fluid communication with the plurality of fluid filter openings of the stack of thin film layers and the firing chambers of the chamber layer.

24. The fluid ejection device of claim 23 wherein the fluid channel extends laterally along the chamber layer.

25. The fluid ejection device of claim 21 wherein the fluid supply conduit of the first substrate defines a fluid manifold that extends laterally along the first substrate so as to be in fluid communication with the plurality of fluid filter openings of the stack of thin film layers.

26. The fluid ejection device of claim 18 wherein the first substrate is a semiconductor silicon wafer.

27. The fluid ejection device of claim 18 wherein at least a portion of the chamber layer is a metal material.

28. The fluid ejection device of claim 18 wherein at least a portion of the chamber layer is a light sensitive photoresist polymer.

29. The fluid ejection device of claim 18 wherein the at least one fluid energizing element is a resistor.

30. The fluid ejection device of claim 18 wherein the stack of thin film layers includes a plurality of independently addressable fluid energizing elements, and wherein the chamber layer includes a plurality of firing chambers, such that each fluid energizing element of the plurality of independently addressable fluid energizing elements has its own firing chamber.

31. The fluid ejection device of claim 30 wherein the fluid ejection device is mounted to a housing having an ink fluid reservoir in fluid communication with the fluid supply conduit of the first substrate, the fluid ejection device, the housing and the ink fluid reservoir defining an ink jet cartridge usable in an ink jet printer.

32. The fluid ejection device of claim 18 wherein the chamber layer includes:

a barrier layer defining the first surface of the chamber layer affixed to the second surface of the stack of thin film layers, and a second surface; and an orifice layer having a first surface affixed to the second surface of the barrier layer, and an exterior second surface defined by the second surface of the chamber layer, the orifice layer defining the at least one firing chamber positioned over the at least one fluid energizing element of the stack of thin film layers, with the at least one firing chamber opening through at least one nozzle aperture in the exterior second surface of the orifice layer.

33. An ink jet printhead comprising:

a first substrate having a first surface and a second surface, the first substrate defining an ink fluid supply conduit;

a stack of thin film layers having a first surface and a second surface, the first surface of the stack of thin film layers being affixed to the second surface of the first substrate, the stack of thin film layers including at least one ink energizing element;

a barrier layer having a first surface and a second surface, the first surface of the barrier layer being affixed to the second surface of the stack of thin film layers, the barrier layer defining a plurality of fluid filter openings in fluid communication with the ink fluid supply conduit of the first substrate, each fluid filter opening of the plurality of fluid filter openings extending only through the barrier layer from the first surface to the second surface thereof, the plurality of fluid filter openings functioning as an ink fluid filter; and an orifice layer having a first surface affixed to the second surface of the barrier layer, and an exterior second surface, the orifice layer defining at least one firing chamber in fluid communication with the plurality of fluid filter openings of the barrier layer, the at least one firing chamber being positioned over the at least one ink energizing element of the stack of thin film layers, with the at least one firing chamber opening through at least one nozzle aperture in the exterior second surface of the orifice layer.

34. The ink jet printhead of claim 33 wherein the stack of thin film layers define a fluid feed passageway in fluid communication with the ink fluid supply conduit of the first substrate.

35. The ink jet printhead of claim 33 wherein the barrier layer further defines a barrier layer fluid channel in fluid communication with the plurality of fluid filter openings of the barrier layer and the at least one firing chamber of the orifice layer.

36. The ink jet printhead of claim 35 wherein the barrier layer fluid channel extends laterally along the barrier layer.

37. The ink jet printhead of claim 35 wherein the fluid feed passageway of the stack of thin film layers defines a thin film layer ink fluid manifold that extends laterally along the stack of thin film layers so as to be in fluid communication with the plurality of fluid filter openings of the barrier layer.

38. The ink jet printhead of claim 37 wherein the ink fluid supply conduit of the first substrate defines a substrate ink fluid manifold that extends laterally along the first substrate so as to conform with the thin film layer ink fluid manifold of the stack of thin film layers.

39. The ink jet printhead of claim 33 wherein the orifice layer further defines an orifice layer fluid channel in fluid communication with the plurality of fluid filter openings of the barrier layer.

40. The ink jet printhead of claim 39 wherein the orifice layer fluid channel extends laterally along the orifice layer.

41. The ink jet printhead of claim 39 wherein the barrier layer further defines a barrier layer fluid channel in fluid communication with the orifice layer fluid channel and the at least one firing chamber of the orifice layer.

42. The ink jet printhead of claim 41 wherein the orifice layer fluid channel extends laterally along the orifice layer, and the barrier layer fluid channel extends laterally along the barrier layer.

43. The ink jet printhead of claim 33 wherein the stack of thin film layers includes a plurality of independently addressable ink energizing elements, and wherein the orifice layer includes a plurality of firing chambers and nozzle apertures, such that each ink energizing element of the plurality of independently addressable ink energizing elements has its own firing chamber and nozzle aperture.

44. The ink jet printhead of claim 43 wherein each fluid filter opening of the plurality of fluid filter openings of the barrier layer is in fluid communication with more than one of the firing chambers of the plurality of independently addressable ink energizing elements.

45. The ink jet printhead of claim 33 wherein the barrier layer is a light sensitive photoresist polymer.

* * * * *